United States Patent [19]

Habrant

[11] 4,058,946

[45] Nov. 22, 1977

[54] WALLCOVERING

[76] Inventor: Yvon Habrant, 20 Square des Laminees, 63100 Clermont-Ferrand, France

[21] Appl. No.: 720,207

[22] Filed: Sept. 3, 1976

[51] Int. Cl.[2] ..... E04B 1/00

[52] U.S. Cl. ..... 52/273; 16/16; 160/398

[58] Field of Search ..... 52/222, 273, 65, 512, 52/145, 267; 16/16; 160/327, 328, 403, 404, 349 R, 398; 24/73 B

[56] References Cited

U.S. PATENT DOCUMENTS

| | | | |
|---|---|---|---|
| 2,554,674 | 5/1951 | Karas | 16/16 |
| 3,657,850 | 4/1972 | Billarant | 52/222 |

*Primary Examiner*—Price C. Faw, Jr.

*Assistant Examiner*—Carl D. Friedman

*Attorney, Agent, or Firm*—Young & Thompson

[57] ABSTRACT

A wallcovering comprises fabric which is grasped at its edges between a moulding bracket fixed to a wall at a corner of the room, and the adjacent wall, floor, ceiling or moulding with which the first-mentioned wall forms a right angle at the corner. Thus, an entire wall can be covered from side to side thereof, and from top to bottom thereof, or from top to a lower moulding thereon. A spatula is used to force the edges of the fabric between the emplaced moulding strips and the corresponding surface of the room, and the moulding strips have wings thereon inclined in the direction of insertion of the fabric, to prevent escape of the clasped edge of the fabric. Padding such as heat or sound insulation may be disposed between the fabric and the covered wall.

2 Claims, 5 Drawing Figures

WALLCOVERING

The present invention relates to wallcoverings.

It is an object of the present invention to provide a wallcovering which extends from side to side of the wall.

It is another object of the present invention to provide a wallcovering that requires no hangers or frames.

Still another object of the present invention is the provision of a wallcovering with sound and/or heat insulation beneath it.

Finally, it is an object of the present invention to provide a wallcovering which will be relatively simple and inexpensive to manufacture and install, and rugged and durable in use.

Other objects, features and advantages of the present invention will become apparent from a consideration of the following description, taken in connection with the accompanying drawing, in which.

Figure 1:
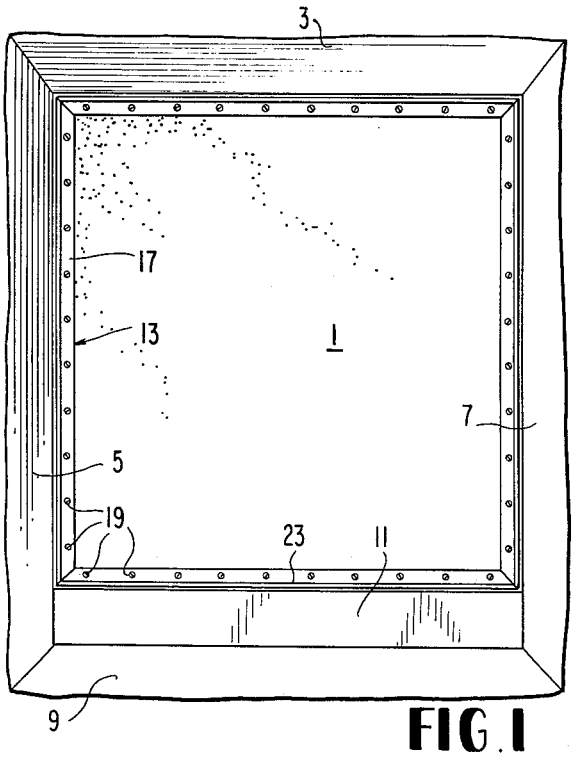
FIG. 1 is an elevational view of a wall to be covered according to the present invention, with the fabric securing strips in place thereon.

Referring now to the drawing in greater detail, and first to FIG. 1 thereof, there is shown in elevation a vertical wall 1 of a room that is completed by a ceiling 3, side walls 5 and 7 and a floor 9, as well as a baseboard or moulding 11 that extends from the floor up to a height corresponding to the lower edge of the covering to be installed.

It will be noted that in FIG. 1, moulding strips 13 according to the present invention have been installed in a rectangular configuration, up against the ceiling and the side walls, and at the bottom against the top of the moulding 11.

Figure 2:
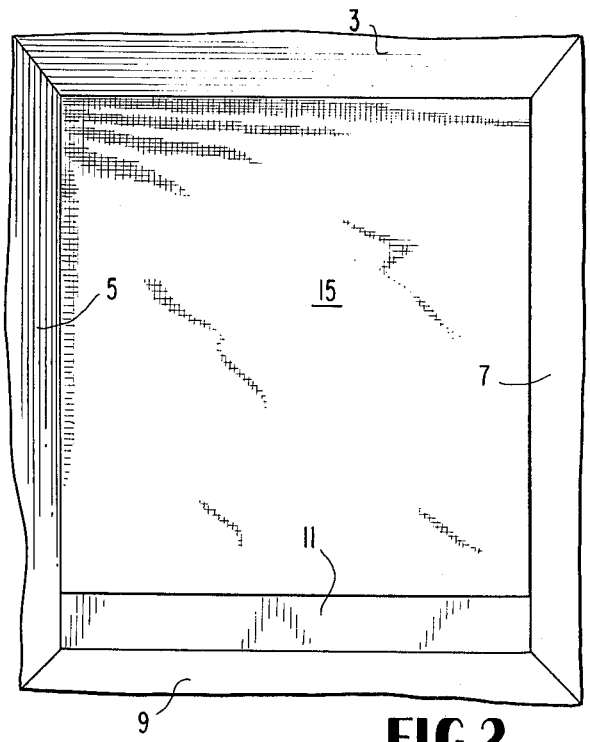
FIG. 2 is a view similar to FIG. 1 but of the covered wall.

FIG. 2 shows the fabric 15 covering the moulding strips 13, the edges of the fabric having been forced between the moulding strips 13 and the adjacent ceiling and side walls and moulding 11. It will of course be understood that the moulding 11 can be eliminated and the lowermost moulding strip 13 can be applied against the floor 9, whereupon the entire wall 1 will be covered by the fabric 15.

Figure 3:
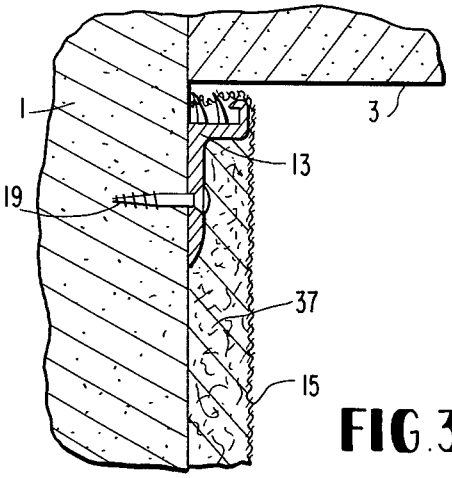
FIG. 3 is an enlarged fragmentary cross-sectional view on the line 3—3 of FIG. 2.

FIG. 3 shows an enlarged cross-sectional view of the manner in which the fabric 15 is held against the ceiling 3 by a strip 13. From FIG. 4, it will be seen in greater detail how the strip 13 in fact performs this retention. Strip 13 is comprised by a flat base 17 which is secured to wall 1 at a plurality of points by screws 19 passing through holes 21 in base 17. Alternatively, of course, strips 13 can be adhesively secured to wall 1.

Figure 4:
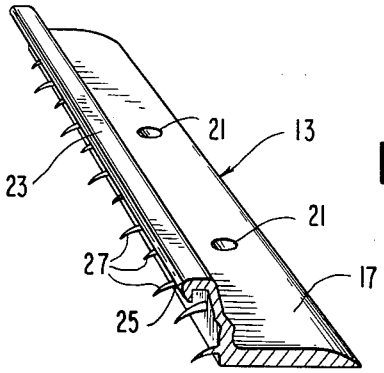
FIG. 4 is a fragmentary perspective view of the moulding strip of the present invention.

Upstanding from base 17 is a flange 23 that terminates upwardly in a somewhat rounded upper edge 25. On the side of flange 23 which is opposite base 17, below upper edge 25 thereof, are provided a plurality of points or prongs 27 that are inclined in a direction away from edge 25, that is, downwardly and away from base 17 as seen in FIG. 4. Each point 27 is integral with the flange 23, the various points 27 being spaced apart lengthwise of flange 23 and arranged in any desired pattern, e.g. quincunxially.

It will of course be understood that strips 13 can conveniently be formed of aluminum, although they can also be of any other corrosion-resistant material such as stainless steel, rigid plastic, or the like.

Figure 5:
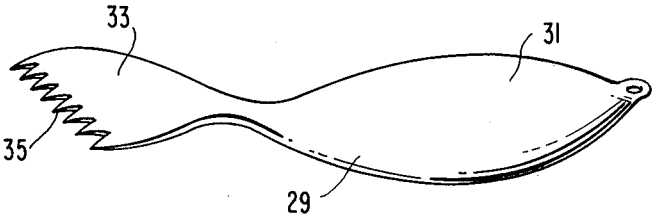
FIG. 5 is a perspective view of a spatula useful for installation of the fabric comprising the wallcovering of the present invention.

In FIG. 5 is shown a tool for the assembly of fabric 15 to wall 1, in the form of a spatula 29 having a handle 31 and a curved portion 33 that terminates in teeth 35.

To assemble fabric 15 to the wall 1, it is necessary only to trim appropriate lengths of strips 13 and secure them to the wall as shown in FIG. 1, against the respective ceiling, side walls, baseboard and/or floor. Thereafter, the fabric 15 is cut to a length and width slightly greater than the greatest outside dimensions of the rectangle defined by the strips 13; and using the spatula 29, the fabric 15 is progressively forced between the strips 13 and the adjacent wall, ceiling, baseboard and/or floor, about all four edges of fabric 15, whereupon the installation is complete.

If desired, batting in the form of cotton batting, synthetic fiber batting, sheet plastic foam, sheet foam rubber or the like, as shown in FIG. 3 at 37, can be provided for the purpose of imparting a desirable padded appearance to fabric 15, or for heat and/or sound insulation purposes. Of course, the padding 37, if used, is installed after the strips 13 are emplaced but before the fabric 15 is applied and may be adhesively bonded or otherwise secured to the wall 1.

From a consideration of the foregoing disclosure, therefore, it will be evident that all the initially recited objects of the present invention have been achieved.

Although the present invention has been described and illustrated in connection with a preferred embodiment, it is to be understood that modifications and variations may be resorted to without departing from the spirit of the invention, as those skilled in this art will readily understand. Such modifications and variations are considered to be with in the purview and scope of the present invention as defined by the appended claims.

I claim:

1. In a room having a wall to be covered, and side walls and a ceiling adjacent said wall to be covered, said side walls and ceiling forming a plurality of corners with said wall to be covered; the improvement comprising a wallcovering comprised by a plurality of molding strips on said wall to be covered next to at least said ceiling and said side walls and extending in closely spaced parallel relationship to said corners, and fabric parallel to and spaced from said wall to be covered, the edges of the fabric being clasped between said molding strips and the ceiling and side walls, said molding strips each comprising a base secured to said wall to be covered and an upstanding flange that extends along one of said ceiling and side walls, said flange having thereon a plurality of sharp points that are inclined in the direction of the adjacent said corner, whereby fabric may be forced in the direction of said corner between said flange and said ceiling or side wall with which said wall to be covered forms said corner toward which said points are inclined, the fabric then being retained in said corner by said points.

2. Structure as claimed in claim 1, said flange having a rounded upstanding edge that extends away from said flange in substantially the same direction as said points, whereby said fabric passes said edge before it encounters said points.

* * * * *